US006193086B1

(12) United States Patent
Gunnlaugsson et al.

(10) Patent No.: US 6,193,086 B1
(45) Date of Patent: Feb. 27, 2001

(54) GANTRY CRANE WITH IMPROVED MANUALLY VARIABLE CONTROLS FOR MOVABLE COMPONENTS

(75) Inventors: Robbie M Gunnlaugsson; Thomas H. Feider, both of Sturgeon Bay, WI (US)

(73) Assignee: Marine Travelift, Inc., Sturgeon Bay, WI (US)

( * ) Notice: Subject to any disclaimer, the term of this patent is extended or adjusted under 35 U.S.C. 154(b) by 0 days.

(21) Appl. No.: 09/042,325

(22) Filed: Mar. 13, 1998

(51) Int. Cl.[7] ..... B66C 13/54
(52) U.S. Cl. ..... 212/290; 212/291; 212/344
(58) Field of Search ..... 414/460; 212/343, 212/344, 345, 290, 291

(56) References Cited

U.S. PATENT DOCUMENTS 3,856,102 * 12/1974 Queen ..... 180/45
4,638,883 * 1/1987 Morizumi et al. ..... 180/324
4,700,802 * 10/1987 Fought ..... 180/324
4,995,472 * 2/1991 Hayashi et al. ..... 180/234
5,957,235 * 9/1999 Nishimura et al. ..... 180/306
5,996,341 * 12/1999 Tohji ..... 60/421
5,996,722 * 12/1999 Price ..... 180/403

* cited by examiner

*Primary Examiner*—Thomas J. Brahan
(74) *Attorney, Agent, or Firm*—Wallenstein & Wagner, Ltd.

(57) ABSTRACT

A crane is disclosed, with one or more moveable components. Manually-articulable controls (such as joysticks) are provided for controlling movement of the components. First, second, and third control circuits responsive to varied positions of the control are optionally connected to the control to provide first, second, and third sets of control signals each with differing responses to the control in a given position so as to move the components in a manner which mitigates instability or inaccuracy due to the physical acuity of the operator.

30 Claims, 3 Drawing Sheets

GANTRY CRANE WITH IMPROVED MANUALLY VARIABLE CONTROLS FOR MOVABLE COMPONENTS

TECHNICAL FIELD

The present invention relates generally to cranes, and more particularly to circuitry and apparatus which are manually variable for controlling moveable components of the crane, such as booms, lift frames, winches, trolleys, hydraulic cylinders, hydraulic motors, valves, and wheels which move the cranes.

BACKGROUND OF THE INVENTION

Cranes, such as gantry cranes are used for lifting and handling loads. In particular, gantry cranes are used to lift such as truck trailers, cargo containers, boats and the like. The cranes normally have a gantry structure that spans over the load(s). For example, in intermodal applications, the crane may span over two adjacent railroad cars, a truck trailer adjacent a railroad car or side-by-side stacks of containers. Gantry cranes are frequently self-mobile, moving on tracks or wheels.

Conventionally, some sort of apparatus, such as a lift frame or a lifting yoke, is suspended from the gantry structure to engage and lift loads. Such apparatus must be moveable at least up and down. For intermodal applications the apparatus is also preferably moveable side-to-side and may be tilted end-to-end and side-to-side.

Movement of the crane itself and its moving components is generally accomplished directly, or indirectly, by the operator using control circuitry and apparatus which is manually-actuated and articulated to achieve desired variable speeds and directions. Controls, such as, joysticks, manually-rotatable wheels or roller balls, foot pedals and the like are moved and positioned by an operator. The movement and position are translated into a control signal to move and position a given component of the crane itself.

These controls must provide a wide range of control. For example, to engage loads and to maneuver in limited spaces, the controls must provide for slow and careful movement of the crane and its components. On the other hand, because of the high duty cycles required for efficient commercial operations, the controls must also provide for higher speeds when such precision of movement is not required. Also, for speed and efficiency of operation, an operator must be able to quickly and continuously vary the speeds from low to high and any appropriate speeds in-between.

Accordingly, conventional control systems provide manual controls permitting a continuous range of vehicle and component movement speed from a minimum to maximum speed which is relatively broad. Thus, accuracy and consistency of speed and direction affected by the manual controls on the vehicle or a given component is a function of the physical acuity of the operator attempting to physically position the control appropriately between its maximum and minimum value.

This poses a problem during operations which require a great deal of very precise, or slow, movement such as encountered by operators when positioning the crane or its lifting apparatus for proper engagement with, or over, a load.

For example, when using a conventional joystick to control the crane or its other moveable components, the operator can repeatedly overshoot, or undershoot, the position desired to properly align a lifting apparatus over the load. This is particularly problematic when twist locks are involved where all four corners of a lifting apparatus must be aligned with all four upper comers of a container to be lifted. Using the mechanical range and variable response of a conventional joystick to properly align the twist locks can be difficult and time consuming.

Another example of an operation which requires precision of speed and direction of movement is found in marine applications where the crane wheels must be directed on narrow sea walls in order to position the crane over a boat in the water. Such sea walls are frequently not much wider than the wheels of the crane and a small control error by the operator could be disastrous.

The present invention is proposed to solve these problems and to provide other advantages not provided in the same manner by conventional apparatus.

SUMMARY OF THE INVENTION

The present invention provides a control apparatus which changes the response of a moveable component of a gantry crane or the gantry crane itself, to a manually-articulable control when more precision of movement is desired. More particularly, a means is provided for changing the response to a given manual control when the means is activated. The means may either scale the range of response or provide a single constant output in response to manual activation.

In one embodiment of the invention, electronic circuitry, in the form of first and second control circuits, is used to control the rate, amount or direction of movement of the component or components. A manually-articulable control is provided which has a physical, mechanical range of movement. The manually-articulable control can be switched between the first and the second control circuits.

When connected to the first control circuit, a first range of control signals is generated in response to the manually-articulable control, the value of the signal corresponding to the mechanical range of manipulation of the control. Thus, when the first circuit is connected to the manually-articulable control, the control signal is dependent upon, and proportional to, a crane operator's manual articulation over the entire mechanical range of manipulation of the control. Accordingly, the rate and amount of movement of the moveable component are proportional to the crane operator's manual input over the mechanical range of manipulation of the manually-articulable control between a maximum and a minimum speed or amount of response.

When the manually-articulable control is connected to the second control circuit, a preset control signal is produced in response to any motion or position of the manually-articulable control after actuation. Thus, regardless of the precision or steadiness of the operator's physical manipulation of the manually-articulable control, the movement of the component is at a constant speed. Alternatively, the second circuit could be separately controlled by a second control.

In another embodiment of the invention, when the manually-articulable control is connected to the second control circuit, a second range of control signals is produceable in response to manipulation of the manually-articulable control over its entire range of manipulation. The second range of control signals is scaled to be a fraction of the first range of control signals. In other words, over the entire range of mechanical manipulation of the manually-articulable control, the first control circuit will produce movement of the moveable component from a minimum speed to a maximum speed. On the other hand, over the entire range of physical manipulation of the manually-articulable control, the second control circuit will produce movement of the moveable component from the minimum speed only up to a fraction of the maximum speed provided by the first control circuit.

According to another aspect of the present invention, the second control circuit has a means for variably adjusting the scaling of the second range of control signals or adjusting the preset constant speed control signal.

According to another aspect of the invention, means are provided to permit the operator to select either a second range of control signals, or a single preset signal provided by second and third control circuits.

According to another aspect of the invention, conveniently operable and accessible means are provided for switching between the first and second circuits.

Other advantages and aspects of the present invention will become apparent upon reading the following description of the drawings and detailed description of a preferred embodiment of the invention.

DETAILED DESCRIPTION

Figure 1:
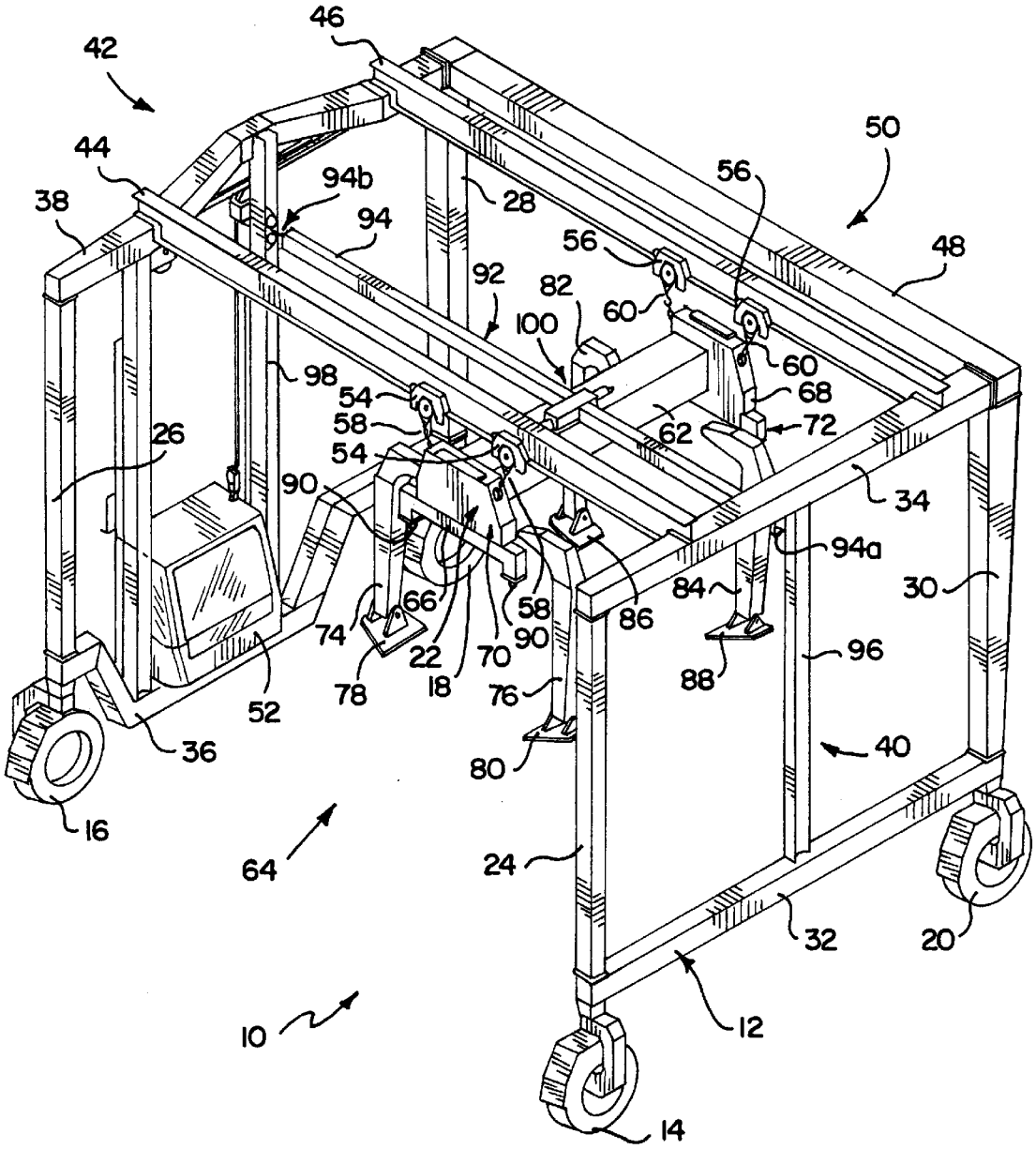
FIG. 1 is a perspective view of a gantry crane having control circuitry according to the present invention.

While this invention is susceptible of embodiment in many different forms, there is shown in the drawings-and will herein be described in detail preferred embodiments of the invention with the understanding that the present disclosure is to be considered as an exemplification of the principles of the invention and is not intended to limit the broad aspect of the invention to the embodiments illustrated.

FIG. 1 discloses a gantry crane 10 comprising a plurality of stationary components, which form the gantry frame 12, and a plurality of moveable components connected to the stationary components. While there are numerous moveable components on the gantry crane 10 (discussed in detail below), the components primarily used to ensure proper position for engagement of loads are wheels 14, 16, 18, 20 and a lift frame 22.

Gantry Frame

The gantry frame 12 has four vertical columns, 24,26,28, 30. Columns 24 and 30 are connected by a lower sill beam 32 and an upper sill beam 34 to form a first side frame 40. Columns 26 and 28 are similarly connected by a lower sill beam 36 and an upper sill beam 38 to form a second side frame 42. The first and second side support frames 40,42 are interconnected by a main support beam 48 at end 50 of the gantry crane 10 and by trolley beams 44, 46. The trolley beams 44 and 46 are preferably I-beams and are mounted on upper side beams 34,38. A vertically moveable operator cab 52 is mounted on one side support frame of the gantry frame 12. The gantry frame 12, thus formed, is an open-ended boxlike structure sufficient to span over adjacent loads, such as two railcars or a railcar adjacent a truck trailer, -or merely single loads. The benefits of the present invention, however, can be realized with other structures.

The Moveable Components

FIG. 1 discloses wheels 14, 16, 18, 20, which are each individually powered by a dedicated hydraulic motor to make the gantry crane 10 self-mobile. The gantry crane 10 could also be self-mobile by means of railroad-track wheels, link-belt-type tracks, or the like.

The lift frame 22 is moved side-to-side by pairs of trolleys 54, 56. Lift cables 58, 60 provide for vertical lifting of the lift frame 22.

A first end 66 of a lift frame body 62 is suspended from the trolleys 54 by the lift cables 58 by suitable reeving (not shown) coupled to the trolleys 54. A second end 68 of the lift frame body 62 is suspended from the trolleys 56 by the lift cables 60 in a similar manner. Lift cables 58,60 extend from the reeving on the trolleys to first and second winches, respectively (not shown) which are mounted on the gantry frame 12 through suitable reeving for independent vertical movement of the ends 66 and 68 of lift frame 22. The first and second winches are each individually powered by a dedicated hydraulic motor (not shown but further explained in connection with FIG. 2). The first and second ends 66,68 of the lift frame 62 are permitted to be raised and lowered independently of one another to properly position the lift frame 62 when the load to be lifted is seated at an angle relative to the gantry frame 12.

Trolleys 54,56 move laterally on first and second trolley beams 44,46 via cables attached between the trolleys 54,56 and third and fourth winches (not shown). The third and fourth winches are each powered by a dedicated hydraulic motor (also not shown but further explained in collection with FIG. 2). The trolleys 54,56 move independently on the trolley beams 44,46 so as to provide parallel alignment of the lift frame body 62 with loads which are not parallel with side support frames 40,42.

The lift frame 62 is equipped with moveable spreaders 70,72. The spreader 70 has moveable arms 74,76 that depend from the lift frame body 62. Arms 74, 76 have a pivotal pivot shoes 78, 80.

Similarly, spreader 72 has moveable arms 82,84. The arm 82 has a pivot shoe 86 and arm 84 has pivot shoe 88. The pivot shoes 78, 80, 86, 88 may be pivotally rotated to engage under a load, such as a cargo container.

When it is desired or necessary to engage a load at its top, the arms 78, 80, 82, 84 can rotate upward, out of the way, and the load can be engaged by specialized twist locks 90 located on the lift frame 62 (only two of the four twist locks 90 are shown).

Lift frame body 62 can be extended or retracted longitudinally as necessary to space spreaders 70, 72 or twist locks 90 to adjust to various load lengths. The lift frame body 62 includes various hydraulic mechanisms such as hydraulic cylinders or motors to move the above-described moveable components, as is conventional.

The gantry crane 10 is also equipped with stabilizing apparatus 92 to prevent unwanted sway of the lift frame 62 within the gantry structure 12. The stabilizing apparatus generally includes a horizontal stabilizing beam 94 with vertical guides 96, 98 to prevent longitudinal and lateral sway, i.e., pendulous motion of the lift frame 62. The stabilizing beam 94 operatively connects the lift frame 62 to the gantry structure 12.

The lift frame 62, is pivotally connected to the stabilizing beam 94 by a gimbal 100. First and second ends 94*a*, 94*b* of the stabilizing beam 94 are connected to the first and second vertical guides 96, 98 which are connected to the first and second side support frames 40, 42, respectively. A more detailed explanation of the structure and operation of the stabilizing apparatus 92 can be found in U.S. patent application Ser. No. 08/377,427 filed Jan. 24, 1995, which is specifically incorporated herein by reference.

Control of the Moveable Components

The above-described moveable components are moved by way of hydraulics, and suitable hydraulic circuitry is provided for conducting the necessary hydraulic fluids. Both cylinders and hydraulic motors used for moving the components are controlled by hydraulic spool valves which regulate the flow of hydraulic fluid. The spool valves are controlled by stepper motors which are controlled by electric control circuits linked to manually-articulable controls as will now be described in general.

Figure 2:
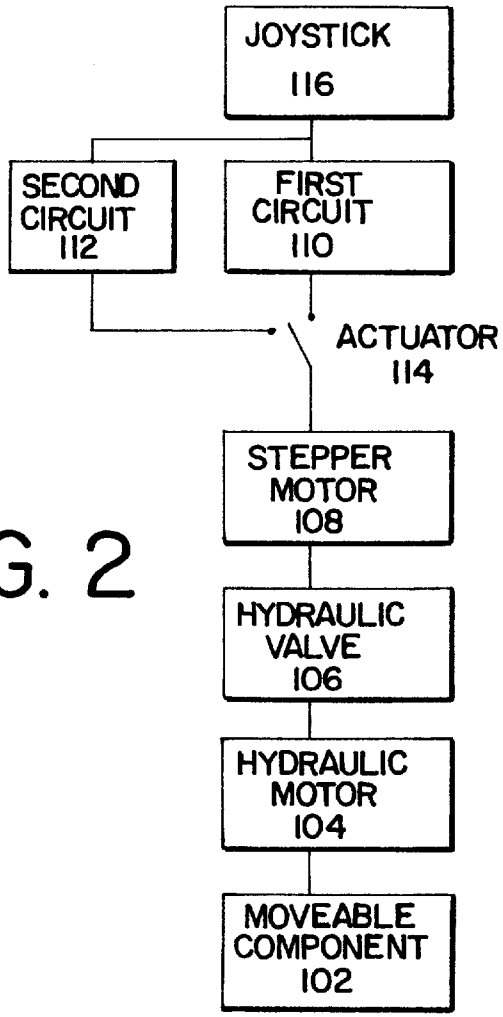
FIG. 2 is a block diagram of an electro-hydraulic circuit having first and second control circuits according to the invention.

FIG. 2, schematically discloses a moveable component 102 (such as one of the wheels 14, 16, 18, 20) which is driven by a hydraulic motor 104, and controlled by a hydraulic valve 106. The hydraulic valve 106 is controlled by a stepper motor 108. As is known in the art, the amount of hydraulic fluid permitted to be delivered to hydraulic motor 104, by the hydraulic valve 106, as well as the rate of fluid transfer, determines the amount the hydraulic motor 104 moves, and the speed at which it moves. Accordingly, this controls the amount which the moveable component 102 moves as well as its speed. The change in position of the moveable component 102 is based upon the length of time the hydraulic valve 106 is permitted to deliver hydraulic fluid to the hydraulic motor 104 times the rate at which hydraulic fluid is being delivered to the hydraulic motor 104 over that time.

Electronic circuitry comprising stepper motor 108, a first control circuit 110, an actuator 114, and a manually-articulable joystick 116 is provided to control the amount and rate of hydraulic fluid through the hydraulic valve 106 to control at least one aspect of the movement of moveable component 102. Thus, in general operating modes where a wide range of speeds, and movement are needed, the first control circuit 110 responds to the position of the joystick 116 to provide a control signal to the stepper motor 108. It will be appreciated by those skilled in the art that a circuit, such as circuit 110, can also provide independent control signals to more than one moving component in response to the position of the joystick 116. For example, in many cranes with wide spans between wheels the Ackerman Steering Principal is applied to turn each wheel to a different steering angle to accomplish a given turn in response to a joystick or steering wheel so as to avoid undue stress or wear on the wheels or gantry frame. In a second mode of operation, where more precision control of the moveable component 102 is desired (also referred to herein as an "inching" mode), a second control circuit 112 is employable. In the inching mode, the operator engages actuator 114 to connect the second control circuit 112. The second control circuit 112 then generates a control signal to the stepper motor 106 in response to the position of the joystick 116, to control the moveable component 102.

Thus, over the range of physical manipulation of the joystick 116, the circuits 110 and 112 provide independent, first and second ranges of control signals for controlling the movement of component 102. The first range of movement is from a minimum to a maximum desired speed and range of movement. The second range speed is scaled to a desired fraction of the first range between minimum and maximum values. Thus, at any position of the joystick 116 when engaged with the second control circuit 112, the moveable component 102 will only move at that desired fraction of the speed it would have moved at that same position under control the first control circuit 110.

In an alternate embodiment, the second control circuit 112 can be used to provide a single preset signal, causing a single preset rate of movement of the moveable component 102 when the joystick 116 is moved, or actuated. This rate is usually relatively slow so that the moveable component 102 can be "inched" into position, such as to properly align the gantry crane 10 or lift frame 22 over a load. In this mode, the length of time the operator engages the joystick 116 is determinative of the movement, not the relative position of the joystick after engagement.

It should be noted that the second control circuit 1 12 may include an adjustment component to adjust either the preset constant signal to a desired level or to adjust the range limits of the reduced response to the joystick 116.

Also, the actuator 114 may be in the form of a manual switch such as a foot switch, a flip switch, or a particular zone of physical position of the manually-articulable control. Alternatively, two controls could be implemented. The first and second control circuits in this instance would each be responsive to first and second control, respectively. Additionally, the actuator 114 could be a cam switch on one of the first or second controls. Such actuators are exemplified by the embodiments below.

Figure 3:
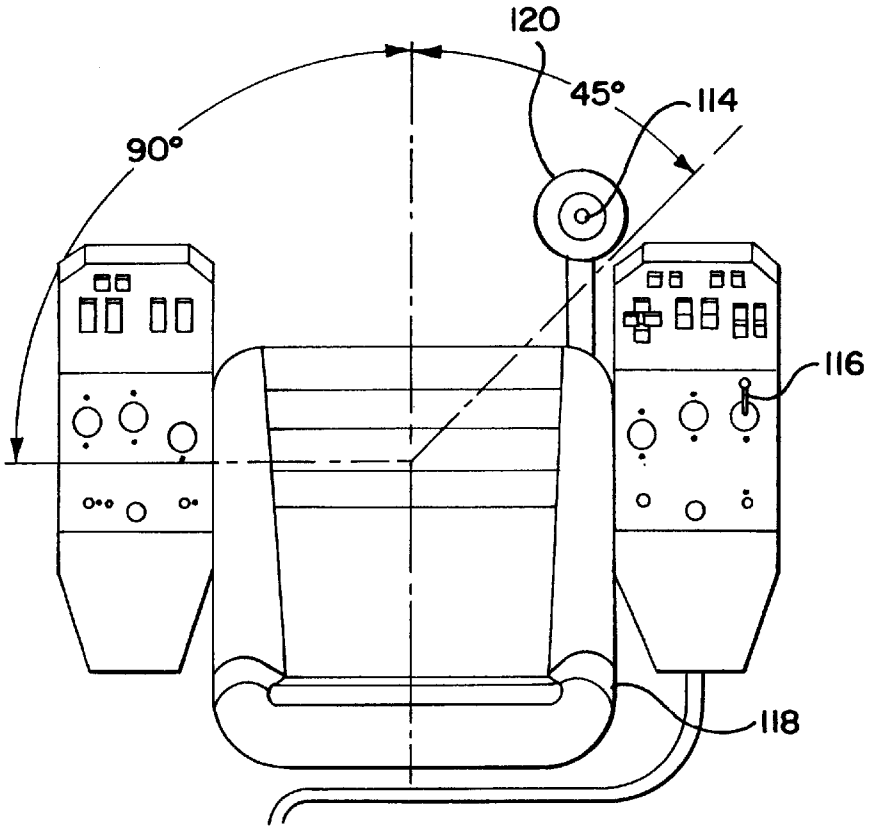
FIG. 3 is a schematic representation of a top view of a swiveling operator chair having an actuator connected thereto.

In a preferred embodiment, the actuator 114 is located inside the operator cab 52 (FIG. 1). Specifically, as shown in FIG. 3, a swiveling operator seat 118 is located inside the operator cab 52. The actuator 114 is affixed to a foot rest 120 on the seat 118 so that as the operator seat 118 swivels, the actuator 114 travels with it. The actuator 114 shown in FIG. 3 is a normally-off-biased foot switch; however, as mentioned above, the actuator 114 can take on a variety of forms. An advantage of the foot switch 114 is that an operator may engage or actuate the second control circuit 112 for the moveable component 102 (or for other components) without taking his or her hands away from other hand controls such as joystick 116 located on the control pads of the chair 118 (other controls shown but not numbered).

In a preferred embodiment, a control hierarchy exists between the first control circuit 110 and the second control circuit 112. The first joystick 116 has a neutral position where no signal is generated, and non-neutral positions which generate control signals in a first range dependent on the non-neutral position of the joystick 116. The actuator 114 cannot actuate a second control, and therefore, the second control circuit 112 when the first control, i.e. joystick 116, is in a non-neutral position.

Figure 4:
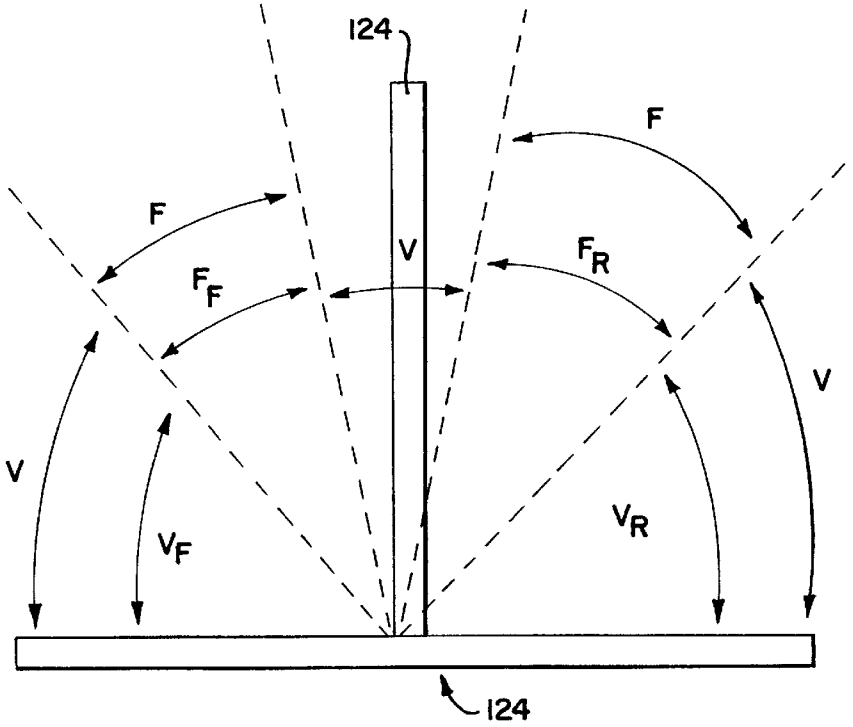
FIG. 4 is a schematic side view of a multipurpose joystick illustrating its different ranges.

FIG. 4 discloses a multifunction joystick 122 which can be used in place of joystick 116 and actuator 114. The joystick 122 has a lever handle 124 which is capable of being positioned in a neutral range N, a fixed rate range F and a variable rate range V. The fixed rate range F may further include a forward fixed rate range $F_f$ and a reverse fixed rate range $F_r$. Likewise, the variable rate range V may include a forward variable rate range $V_f$ and a reverse variable rate range $V_r$. By placing the joystick handle 124 in the forward fixed rate range $F_f$, a preset forward control signal will be generated for moving the moveable component at a desired constant forward speed. Similarly, by placing the joystick handle 124 in the reverse fixed rate range $F_r$, a preset reverse control signal will be generated for moving the moveable component at a preset constant reverse speed. Placement of the joystick handle 124 in.the forward-variable rate range $V_f$ or the reverse variable rate range $V_r$ will produce signals which vary according to the position of the joystick lever 124 within the variable rate range V.

Figure 5:
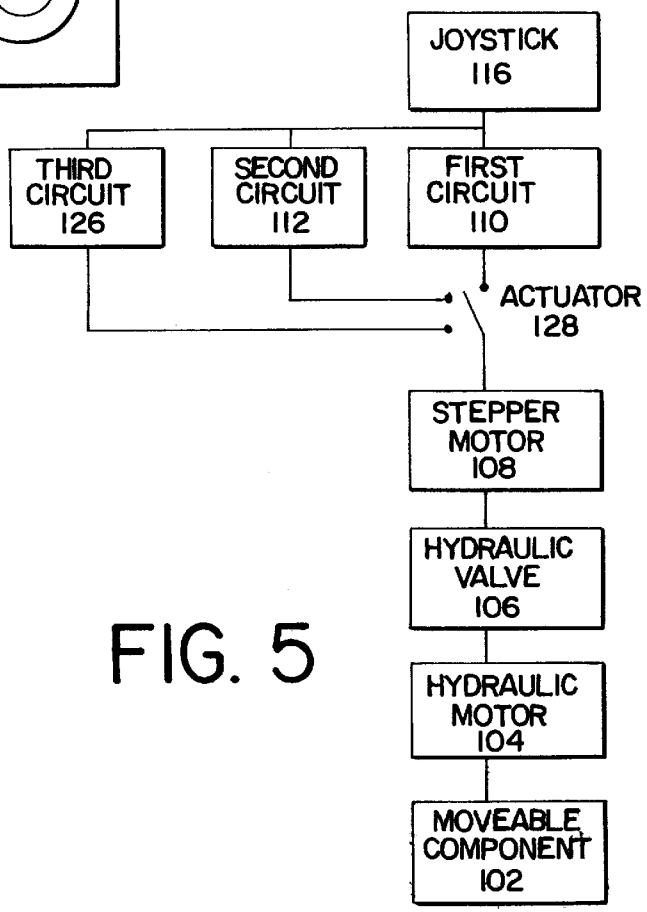
FIG. 5 is a block diagram of another embodiment of the present invention showing electronic circuitry having first, second, and third control circuits; and, FIG. 6 is a schematic representation of foot pedals for actuating alternate circuits.
Figure 6:
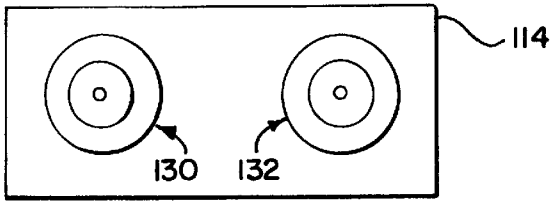

FIG. 5 discloses an alternate embodiment where a third control circuit 126 is employed with first and second control circuits 110, 112. An alternate actuator 128 has three positions so that it is capable of actuating any of the first, second, or third circuits 110, 112, 126 depending upon its position. For example, the actuator 128 may include first and second foot pads 130, 132 as schematically shown in FIG. 6. When neither the first nor second foot pads 130, 132 are depressed, the gantry crane 10 operates in standard operating mode. However, by depressing the first foot pad 130, the second control circuit 112 is actuated to move the moveable component 102 at a preset desired constant speed. Releasing the first foot pad 130 deactuates the second control circuit 112 and returns control to the first control circuit 110. Similarly, by depressing the second foot pad 132, the third control circuit 126 is actuated to provide a scaled signal range to reduce the response of the moveable component 102 to a given manipulation of the joystick 116. Again, by releasing the second foot pad 132, the third control circuit 126 is deactuated and control is returned to the first control circuit 110.

While the specific embodiments have been illustrated and described, numerous modifications come to mind without significantly departing from the spirit of the invention and the scope of protection is only limited by the scope of the accompanying claims. For example, It is contemplated that a manually-articulable control can be any device which is dependant on the operator's physical acuity to position or time its operational effectiveness, such as: a joystick, like joystick 116; a spring-loaded button or foot pedal; a steering wheel; a computer mouse; or, any switch which is biased against operation without physical contact or time-dependant in effecting its operational function. It is also contemplated that devices of the present invention would be advantageous on other than gantry cranes, for example, for controlling moveable components of a mobile boom-type crane.

We claim:

1. A crane comprising:

a frame having at least one moveable component operably coupled thereto;

a power means for moving the moveable component;

a control having a non-activated mode and an activated mode, the control being manually articulable and variably positional in its activated mode;

a first control circuit responsive to the control when connected thereto, the first control circuit providing a first control signal to the power means, the first control signal varying according to varied position of the control in its activated mode, the power means being responsive to the first control signal and moving the moveable component at a speed varying with the position of the control;

a second control circuit responsive to the control when connected thereto, the second control circuit providing a second control signal to the power means, the power means being responsive to the second control signal for moving the moveable component;

an actuator for optionally electrically connecting the first and second control circuits to the power means; and, wherein the control is positional in a first, neutral range of positions, a second range of positions in which the first control circuit is responsive the control's position, and a third range of positions in which the second circuit is responsive to the control's position.

2. The crane of claim 1 wherein the second control signal has a constant value, regardless of the position of the control, once the control is in the activated mode, thus, the power means moves the moveable component at a constant speed independent of the of varied positions of the control.

3. The crane of claim 2 further including a third circuit connectable to the control by the actuator, wherein the third circuit produces a third control signal which varies in proportion to a varied position of the control in its activated mode, the third control signal is scaled relative to the first control signal for any given position of the control so as to provide a reduced response of the power means in response thereto so as to move the moveable component at a slower speed at any given position of the control as compared to a speed resulting from a signal from the first control circuit in response to the same position of the control.

4. The crane of claim 3 having means to vary the value of the constant signal produced by the third control circuit.

5. The crane of claim 3 having means to vary the response of first control circuit to the control and means to vary the second control circuit's constant value output and means to vary the response of the third control circuit to the control.

6. The crane of claim 2 having means to vary the value of the constant signal produced by the second control circuit.

7. The crane of claim 2 having means to vary the response of first control circuit to the control and means to vary the second control circuit's constant value output.

8. The crane of claim 1 wherein the second control circuit produces a second control signal which varies in proportion to a varied position of the control in its activated mode, the second control signal is scaled relative to the first control signal for any given position of the control so as to provide a reduced response of the power means in response thereto, so as to move the moveable component at a slower speed at any given position of the control as compared to a speed resulting from a signal from the first control circuit in response to the same position of the control.

9. The crane of claim 8 having means to vary the response to the second signal relative to the position of the control.

10. The crane of claim 8 having means to vary the response of the first control circuit to the position of the control and means to control the response of the second control circuit to the position of the control.

11. The crane of claim 1 wherein the moveable components are wheels and the power means is a hydraulic motor.

12. The crane of claim 1 wherein the actuator is a manually-operated switch.

13. The crane of claim 1 wherein the control is a joystick.

14. The crane of claim 1 wherein the control includes a computer.

15. The crane of claim 1 wherein the control has a first direction and a second direction of positions, both the first and second control circuits being responsive to each of the first and second range of positions fixed rate range.

16. The crane of claim 1 having means to vary both the first and second control circuit's response to the position of the control.

17. The crane of claim 1 wherein the moveable component comprises a lift frame.

18. The crane of claim 1 wherein the moveable component comprises a trolley beam.

19. The crane of claim 1 wherein the actuator is mounted in an operator cab.

20. The crane of claim 1 wherein the actuator is mounted on an operator seat in an operator cab.

21. A crane comprising:

a frame having at least one moveable component operably coupled thereto;

a power means for moving the moveable component;

a first control having a non-activated mode and an activated mode, the control being manually articulable and variably positional in its activated mode;

a second control;

a first control circuit responsive to the first control and being connected thereto, the first control circuit providing a first control signal to the power means, the first control signal proportional to the position of the control in its activated mode, the power means being responsive to the first control signal to move the moveable component at a speed proportional to the position of the control;

a second control circuit responsive to the second control and being connected thereto, the second control circuit providing a second control signal to the power means, the power means being responsive to the second control signal for moving the moveable component; and, an actuator for optionally electrically connecting any one of a plurality of control circuits to the power means; and, wherein the first control is positional in a first, neutral position and a second range of positions in which the first control circuit is responsive to its position and the second control is positional in first, neutral position and a third range of positions in which the second control circuit is responsive to its position.

22. The crane of claim 21 wherein the second control signal has a fixed constant value, regardless of the position of the control, once the control is in the activated mode.

23. The crane of claim 31 wherein the second control circuit produces a second control signal which varies in proportion to a varied position of the control in its activated mode, the second control signal is scaled relative to the first control signal for any given position of the control so as to provide a reduced response of the power means in response thereto, so as to move the moveable component at a slower speed at any given position of the control as compared to a speed resulting from a signal from the first control circuit in response to the same position of the control.

24. The crane of claim 21 wherein the actuator is a switch which provides a control hierarchy wherein when the first control is operated, the first control is electrically connected to the power means regardless of the position of the second control.

25. A crane comprising:

a frame having at least one moveable component operably coupled thereto;

a power source to move the moveable component;

a manually-articulable control having a non-activated mode and an activated mode;

a first control circuit responsive to the control which provides a first control signal to the power source to move the moveable component;

a second control circuit responsive to the control which provides a second control signal to the power source to move the moveable component;

an actuator for electrically connecting the first or second control circuits to the power source;

wherein the first control signal is proportional to the position of the control to vary the rate of movement of the moveable component when electrically connected to the power source; and, wherein the control is positional in a first, neutral range of positions, a second range of positions in which the first control circuit is responsive the control's position, and a third range of positions in which the second circuit is responsive to the control's position.

26. The crane of claim 25 wherein the second control signal has a constant value, regardless of the position of the control, when the control is in the activated mode.

27. The crane of claim 25 wherein the second control signal produced by the second control circuit varies proportionally to the position of the control while the control is in the activated mode.

28. A control circuit for a crane having a moveable component and a power source comprising:

a manually-articulable control having a non-activated mode and an activated mode;

a first control circuit responsive to the control that is adapted to provide a first control signal to the power source to move the moveable component;

a second control circuit responsive to the control that is adapted to provide a second control signal to the power source to move the moveable component;

an actuator adapted to electrically connect the first or second control circuits to the power source;

wherein the first control signal is proportional to the position of the control to vary the rate of movement of the moveable component when electrically connected to the power source; and, wherein he control is positional in a first, neutral range of positions, a second range of positions in which the first control circuit is responsive the control's position, and a third range of positions in which the second circuit is responsive to the control's position.

29. A control circuit for a crane having a moveable component and a power source comprising:

a manually-articulable control having a non-activated mode and an activated mode;

a first control circuit responsive to the control that is adapted to provide a first control signal to the power source to move the moveable component wherein the first control signal is proportional to the position of the control to vary the rate of movement of the moveable component when electrically connected to the power source;

a second control circuit responsive to the control that is adapted to provide a second control signal to the power source to move the moveable component wherein the second control signal has a constant value, regardless of the position of the control; and, an actuator adapted to electrically connect the first or second control circuits to the power source; and, wherein the control is positional in a first, neutral range of positions, a second range of positions in which the first control circuit is responsive the control's position, and a third range of positions in which the second circuit is responsive to the control's position.

30. A control circuit for a crane having a moveable component and a power source comprising:

a manually-articulable control having a non-activated mode and an activated mode;

a first control circuit responsive to the control that is adapted to provide a first control signal to the power source to move the moveable component wherein the first control signal is proportional to the position of the control to vary the rate of movement of the moveable component when electrically connected to the power source;

a second control circuit responsive to the control that is adapted to provide a second control signal to the power source to move the moveable component wherein the second control circuit produces a second control signal which varies in proportion to a varied position of the control in its activated mode and the second control signal is scaled relative to the first control signal for any given position of the control; and, an actuator adapted to electrically connect the first or second control circuits to the power source; and, wherein the control is positional in a first, neutral range of positions, a second range of positions in which the first control circuit is responsive the control's position, and a third range of positions in which the second circuit is responsive to the control's position.

* * * * *

UNITED STATES PATENT AND TRADEMARK OFFICE

CERTIFICATE OF CORRECTION

PATENT NO. : 6,193,086 B1 
DATED : February 27, 2001
INVENTOR(S) : Robbie Gunnlaugsson and Thomas Feider It is certified that error appears in the above-identified patent and that said Letters Patent is hereby corrected as shown below:

Column 6,
Line 13, change "control the" to -- control of the --.

Column 8,
Line 15, change "of the of" to -- of the --.

Column 9,
Line 43, change "31" to -- 21 --.

Column 10,
Lines 12, 42, and 65, change "responsive" to -- responsive to --.

Column 12,
Line 11, change "responsive" to -- responsive to --.

Signed and Sealed this

Fifth Day of March, 2002

*Attest:*

*Attesting Officer*

JAMES E. ROGAN
*Director of the United States Patent and Trademark Office*